US005546691A

United States Patent [19]

Allison

[11] Patent Number: 5,546,691

[45] Date of Patent: Aug. 20, 1996

[54] RIFLE MOUNTED BALLISTIC CHART

[76] Inventor: Mark R. Allison, 832 Poplar St., Denver, Colo. 80220

[21] Appl. No.: 374,418

[22] Filed: Jan. 19, 1995

[51] Int. Cl.[6] ..... F41A 35/00

[52] U.S. Cl. ..... 42/90; 42/100

[58] Field of Search ..... 42/1.02, 90, 100, 42/106, 85

[56] References Cited

U.S. PATENT DOCUMENTS

| | | | |
|---|---|---|---|
| 1,037,308 | 9/1912 | Pinkston | 42/1.02 |
| 1,202,768 | 10/1916 | Arnold | 42/1.02 |
| 1,213,102 | 1/1917 | Hill . | |
| 1,316,391 | 9/1919 | Scarr | 42/100 |
| 1,318,423 | 10/1919 | Williams | 42/100 |
| 2,023,409 | 12/1935 | Coll | 164/80 |
| 2,569,995 | 10/1951 | Kapsa | 42/1.02 |
| 3,826,012 | 7/1974 | Pachmayr | 42/100 |
| 3,984,916 | 10/1976 | Newcomb et al. | 42/100 |
| 4,214,372 | 7/1980 | Rusbach | 42/100 |
| 4,554,745 | 11/1985 | Repa | 33/257 |
| 4,561,204 | 12/1985 | Binion | 42/100 |

*Primary Examiner*—Charles T. Jordan
*Assistant Examiner*—Christopher K. Montgomery
*Attorney, Agent, or Firm*—Davis, Graham & Stubbs LLP

[57] ABSTRACT

A cylindrical casing holds a spring mounted tape upon which is printed ballistic information. The user mounts the casing on a rifle and lines up a shot. While the rifle is in line to be fired, the user, with their trigger hand, extracts the tape from the casing to verify the ballistics of a projectile fired from the weapon by pulling a ring located at the end of the tape. Once the ballistic information is obtained, the user releases the ring which allows the tape to be retracted into the casing.

13 Claims, 1 Drawing Sheet

RIFLE MOUNTED BALLISTIC CHART

FIELD OF THE INVENTION

The field of the invention relates generally to marksmanship, and more specifically to a method of securing and using a rifle-mounted device that provides the user of the rifle with detailed information on the ballistics of various bullet loads fired from the rifle.

BACKGROUND OF THE INVENTION

Whether hunting or target shooting, it is not uncommon for a rifleman to have more than one weapon, each with its own load. As today's rifles become more sophisticated, it is virtually impossible for the user to memorize the detailed ballistic information needed to calculate the bullet drop for one or all of the rifles or loads he or she may use.

As evidenced by the prior art, it can be seen that there have been efforts made to provide sighting information on rifles. For example, U.S. Pat. No. 3,826,012 of Pachmayr discloses a gun sight attachable to a rifle which is adjustable to introduce a variable elevation correction into the sighting of a target, and has a scale or scales reading directly in terms of the proper gun to target distance for any particular setting of the sight.

U.S. Pat. No. 4,554,745 of Repa discloses a device attachable to a rifle for aligning an adjustable sight element in a sight system for rifles. The adjustable sight element within the sight system for rifles includes an aperture disc for a peep sight or an adjustable sight structure for a telescope sight. The adjustable sight element is adjustably mounted for movement about a vertical axis and a horizontal axis in a stationary housing attached to the rifle. The magnitude or degree of horizontal displacement of the adjustable sight element is indicated by a capacitance or optronic measuring device and is displayed digitally in electronic digital fields. The electronic component is located in a casing which is removably attached to the housing.

U.S. Pat. No. 4,561,204 of Binion discloses an opaque reticle display attachment for a rifle equipped with a telescopic sight. The user sights through the telescoping sight with his or her bore axis eye while simultaneously viewing an opaque reticle display screen which is aligned with his or her other eye. The display includes a cross-hairs aiming reticle. Transducers gather information relative to wind velocity and direction, ambient temperature, relative humidity, target elevation, and the like, which affect the ballistic trajectory of a projectile fired from the rifle. The information, alone or with range information, is fed to a microprocessor, which adjusts the position of the cross-hairs reticle on the display for proper aiming of the rifle. The user, by simultaneously viewing through the telescopic sight with one eye and viewing the opaque reticle display with the other eye, combines or superposes the two images into a single field of vision to aim the rifle in accordance with the position of the cross-hairs reticle.

None of these devices is completely satisfactory in providing a light weight, easy and inexpensive solution to the problem.

The applicant is aware of certain devices designed primarily for cutting and measuring. For example, U.S. Pat. No. 2,023,409 of Coll discloses a tape measure device that may be clamped to a pair of scissors. The attachment includes a cylindrical casing that holds a spool with a measuring tape thereon. A clamp to which the cylindrical casing is attached is capable of being clamped upon the shank of a pair of shears. Guide rollers within the cylindrical casing are positioned to be parallel to and adjacent with the blade of the shears, so that the user may measure the material to be cut while the shear is held at the point where the cutting is to begin.

U.S. Pat. No. 1,213,102 of Hill teaches a wrist mounted, spring wound tape measure. This invention discloses an apparatus of cylindrical formation having a hinged cover with a spring catch for securing the cover in a closed position upon the receptacle. The receptacle is designed to be mounted on a band or bracelet which attaches to the wrist of the user. The cover of the receptacle has a central opening so that a finger may touch the spring of a spring wound tape, which is arranged within the casing. The casing has a slot through which the tape may be drawn. In addition, a ring is attached to the end of the tape to prevent the end of the tape from being drawn into the casing.

U.S. Pat. No. 5,257,729 of Silver discloses a tool holder for securing a frequently accessed tool, such as a tape measure, to a user's wrist. The tool holder has a pouch that holds the tape measure, a strap attached to the pouch has loop type fasteners on opposite ends which are wrapped around the user's wrist to hold the strap in place. The pouch has access holes that allow extension and retraction of a tape measure blade so that the tape measure can be used while still attached to the user's wrist.

As seen by the prior art, devices have been developed that mount measuring tapes to instruments whose use often involves the need for measurement tapes. Also, devices have been mounted on firearms that aid in the calculation of firing a trajectory. However, it can be seen that none of them completely solve the problem of providing an easy and inexpensive way for the user of a rifle to calculate the proper aim of the rifle for varying loads and distances. The apparatus should be portable to various types of rifles, while the method of using the device remains the same.

SUMMARY OF THE INVENTION

The present invention provides an apparatus and method for securing frequently accessed information, such as a chart of ballistic information, to the barrel or scope of a rifle. The tool consists of a clamp member attached to a receptacle of cylindrical formation. Within the receptacle is an ordinary spring wound tape which is arranged within the casing. The casing has a side slot through which the tape may be drawn. A ring at the end of the tape contacts with the casing at the opposite sides of the slot to prevent the end of the tape from entering the casing.

It is an object of the present invention to provide a lightweight device that is portable from one rifle to another, that will aid the user of the rifle in proper aiming of the rifle. The information printed on the tape contained in the receptacle includes information relating to the ballistics of various loads fired from the rifle.

The clamp of the device is mounted to the barrel of a rifle scope by securing the lower half of a clamp member to the upper half of the clamp in such a way that the clamp encircles the shaft of the rifle scope. The clamp is secured by tightening a pair of screws located on either side of the tool. The user estimates the range of his or her target and lines up his or her shot. Next, with the rifle in position, the user can remove his or her trigger finger from the weapon, grasp the end ring of the tape in the tools casing, and draw the tape from the casing to verify the range information. The user then releases the tape so that it retracts into the casing, makes any necessary adjustments, then fires the shot. The process may be repeated as many times as necessary.

DETAILED DESCRIPTION OF THE PREFERRED EMBODIMENT

Figure 1:
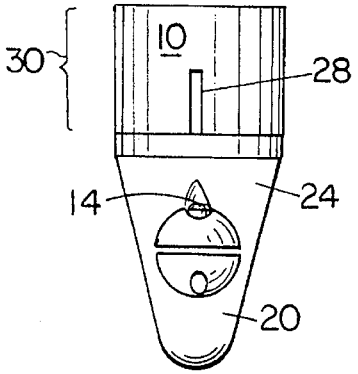
FIG. 1 is an elevational view of the tool of the invention showing the clamping means of the tool.
Figure 3:
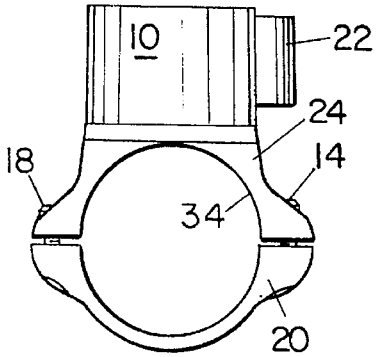
FIG. 3 is front elevational view of the tool of the invention, showing the circumference of the clamping mechanism of the tool.
Figure 6:
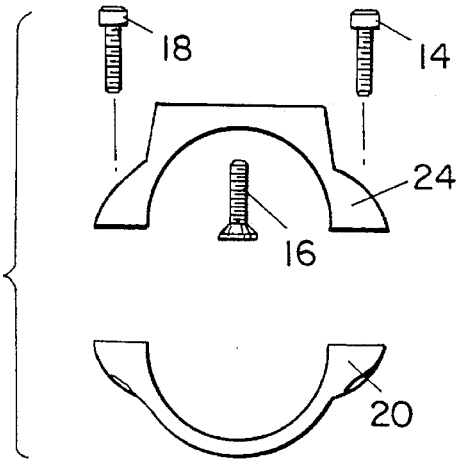
FIG. 6 is a side view of the clamping mechanism of the tool of the invention.

With reference to FIG. 1, it can be seen that the tool of this invention consists of a cylindrical casing 10, an upper bracket 24, a lower bracket 20 and several small threaded screws 14, 16 and 18 (screw 14 is visible in FIG. 1; see FIG. 3 for screws 14 and 18; and see FIG. 6 for all three screws, 14, 16 and 18. The tool of the invention also consists of a small tape 26, readily understood with reference to FIG. 4, which is tightly wound inside the cylindrical casing, as will subsequently be described.

Figure 2:
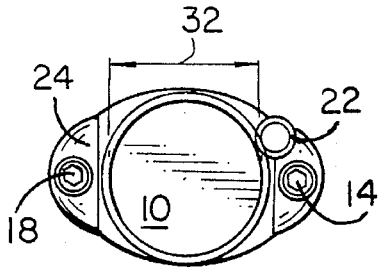
FIG. 2 is a top plan view of the tool of the invention.

The casing 10, cylindrical in shape, may be of any type or design, formed of a metal material such as steel or aluminum, or may be formed of a durable plastic. In a preferred embodiment, the cylindrical casing is formed from a durable plastic material which is lightweight and therefore doesn't add any substantial additional weight to the rifle. Preferably, the height 30 of the casing 10 is 0.7", as can be seen with reference to FIG. 1. The diameter 32 of the casing 10, as seen with reference to FIG. 2 is preferably 1". A diameter of 1" provides for adequate room within the casing for winding the tape contained therein.

Resuming the discussion with reference to FIGS. 3 and 6, it can be seen that casing 10 (FIG. 3) is mounted on upper bracket 24 by central threaded screw 16 (FIG. 6). Threads on the central threaded screw 16 are sized to cooperate with the threads of the threaded hole located on the underside of the casing 10. This provides for a strong engagement of the casing to the tool's clamping mechanism. As will be readily appreciated, a tension clip could also be used to engage the casing to the upper bracket.

Referring now to FIG. 3, it can be seen that upper bracket 24 and lower bracket 20 are formed in such a way that upper and lower hemispheric shaped inner side fit together to form an inner circle 34 whose diameter is 1". The diameter of inner circle 34 is designed to be compatible with standard size rifle scopes in order that, when engaged, upper bracket 24 and lower bracket 20 fit snugly around the barrel of the scope of a rifle.

Upper bracket 24 and lower bracket 20 are securely fastened together in use by a pair of threaded screws 14, 18. Located on both sides of the upper and lower brackets are a pair of threaded holes, designed to be compatible with the threads on the threaded screws 14, 18. It is readily understood with reference to FIGS. 3 and 6 that upper bracket 24 sits on top of the barrel of a rifle's scope, while lower bracket 20 sits below the barrel of a rifle's scope, and the tool is secured on the scope of a rifle by inserting screws 14, 18 through the threaded holes located on either sides of the upper and lower brackets.

Continuing the discussion with reference to FIGS. 1–3, it can be seen that casing 10 has a side slot 28 through which tape 26 (FIG. 4) can be drawn. Side slot 28 begins at the lower portion of the casing and extends up to just below the top of the casing. Side slot 28 is designed to be compatible to the width of tape 26. In a perferred embodiment, this width is just more then 0.5". A ring 22 located at the end of tape 26 contacts the casing 10 on either side of slot 28. Ring 22 prevents the tape 26 from being retracted into the casing.

Figure 4:
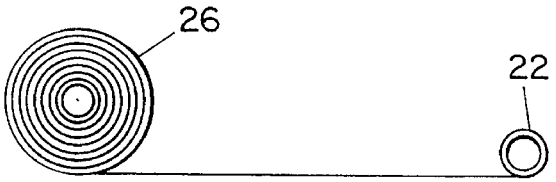
FIG. 4 is a top view of the spring mounted tape.
Figure 5:
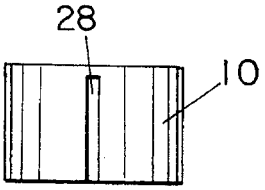
FIG. 5 is a side view of the cylindrical casing member of the tool, showing the slot in the casing through which the spring mounted tape is drawn.
Figure 7:
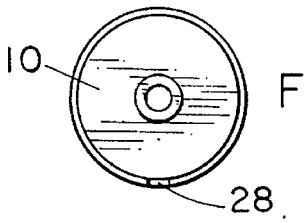
FIG. 7 is a bottom plan view of the cylindrical casing of the tool of the invention without the spring wound tape.

With reference to FIG. 4, one can readily understand tape 26. In a preferred embodiment, tape 26 is about 0.5" wide and approximately 1' long. Tape 26 is formed of a durable yet flexible material, upon which informational charts may be printed. In a preferred embodiment, tape 26 is formed of a thinly pressed metal material such as aluminum. Alternatively, tape 26 may be a lightly colored, tightly woven cloth. Tape 26 is preprinted with ballistic information or charts helpful to a rifleman setting a range for a shot. Alternatively, tape 26 may come in a blank format so that a rifleman may enter his or her own preferred load information.

In operation, the tool of this invention is clamped to the barrel of a scope of a rifle by placing upper bracket 24 over the top of the barrel of the rifle scope, placing lower bracket 20 directly below upper bracket 24 under the barrel of the rifle, and securing by tightening threaded screws 14, 18 into the threaded holes located on either side of the clamps.

The user of the rifle lines up his or her shot, resting the butt of the rifle against his or her shoulder, while supporting the barrel of the rifle with one arm extended. The user of the rifle looks down though the scope of the rifle to ensure that the target is in range. Then, without changing the position of the rifle, the user takes their trigger hand and grasps ring 22 at the end of tape 26 which is wound within casing 10, and pulls tape 26 out of the casing. The user reads the appropriate information from the ballistics chart printed on the tape, and releases ring 22 so that tape 26 retracts back into casing 10. The user then makes any necessary adjustments to their shot and fires. It is readily understood that the tool of this invention may be adapted in a manner that accommodates either a right or left handed rifleman.

I claim:

1. An apparatus for displaying ballistic information comprising:

(a) a cylindrical casing mounted to a scope of a rifle; and (b) a tape, spring loaded within the cylindrical casing, the tape having a manual pull end to pull the tape out of the casing, the tape having ballistic information displayed thereon.

2. An apparatus for displaying ballistic information comprising:

(a) a cylindrical casing;

(b) an upper bracket;

(c) a lower bracket attached to the upper bracket;

(d) a pair of screws for attaching the lower bracket to the upper bracket; and (e) a tape, spring loaded within the cylindrical casing, the cylindrical casing being affixed to the upper bracket, the tape displaying ballistic information, wherein said upper bracket fits over the barrel of a scope of a rifle.

3. The apparatus of claim 2, wherein said lower bracket fits under the barrel of a scope of a rifle.

4. The apparatus of claim 2, wherein said upper bracket and said lower bracket include a pair of matching threaded holes such that said pair of screws may be engaged with said threaded holes to securely mount said upper bracket and said lower bracket to the scope of said rifle.

5. The apparatus of claim 2, wherein said tape is printed with charts containing ballistic information.

6. The apparatus of claim 2, wherein said tape includes a manual pull ring at its distal end.

7. The apparatus of claim 2, wherein said tape is spring mounted inside said cylindrical casing.

8. The apparatus of claim 2, wherein said cylindrical casing has a top, a bottom, a side wall, and a slot on the side wall extended from about the bottom of said casing to about the top of said casing.

9. The apparatus of claim 8, wherein said tape can be extracted from or retracted to said cylindrical casing through said slot, said tape having a ring which prevents said tape from being completely retracted into said casing.

10. A method of using ballistic information comprising the steps of:

(a) mounting a cylindrical casing with a side slot, and upper bracket, a lower bracket, a pair of threaded screws, and a tape printed with ballistic information on the scope of a rifle;

(b) lining up the scope of the rifle with a target in order to take a shot;

(c) grasping an end of said tape with the hand he or she will ultimately use to pull the trigger while keeping the rifle in line with the shot;

(d) extracting said tape from said casing through said slot;

(e) verifying ballistic information for a bullet load from the rifle by reading a predetermined set of data carried on said tape;

(f) releasing said tape so that it retracts into said casing through said slot in the casing.

11. The method of claim 10, further comprising the steps of:

a) adjusting the shot in light of the ballistic information, and b) taking a shot.

12. A method of using ballistic information comprising the steps of:

(a) mounting a cylindrical casing having a tape printed with ballistic information on a scope of a rifle;

(b) lining up the scope of the rifle with a target in order to take a shot;

(c) grasping an end of the tape while keeping the rifle in line with the shot;

(d) extracting the tape from the casing;

(e) verifying ballistic information for a bullet load from the rifle by reading a predetermined set of data carried on the tape;

(f) releasing the tape so that it retracts into the casing.

13. The method of claim 12, further comprising the steps of:

(a) adjusting the shot in light of the ballistic information, and (b) taking the shot.

* * * * *